US011747069B2

(12) United States Patent
Vinard et al.

(10) Patent No.: US 11,747,069 B2
(45) Date of Patent: Sep. 5, 2023

(54) REFRIGERATION PLANT

(71) Applicant: ALPINOV X, Grenoble (FR)

(72) Inventors: Thomas Vinard, Grenoble (FR); Sébastien Bur, Lans en Vercors (FR); Jérôme Girard, Grenoble (FR)

(73) Assignee: ALPINOV X, Grenoble (FR)

( * ) Notice: Subject to any disclaimer, the term of this patent is extended or adjusted under 35 U.S.C. 154(b) by 562 days.

(21) Appl. No.: 16/634,825

(22) PCT Filed: Jul. 25, 2018

(86) PCT No.: PCT/FR2018/051907
§ 371 (c)(1),
(2) Date: Jan. 30, 2020

(87) PCT Pub. No.: WO2019/020940
PCT Pub. Date: Jan. 31, 2019

(65) Prior Publication Data

US 2021/0156603 A1 May 27, 2021

(30) Foreign Application Priority Data

Jul. 28, 2017 (FR) ..... 1757207

(51) Int. Cl.
*F25C 3/04* (2006.01)
*F25C 1/16* (2006.01)
*F25B 23/00* (2006.01)

(52) U.S. Cl.
CPC ..... *F25C 3/04* (2013.01); *F25C 1/16* (2013.01); *F25B 23/006* (2013.01); *F25C 2303/044* (2013.01)

(58) Field of Classification Search
CPC ..... F25C 3/04; F25C 1/16; F25C 2303/044; F25B 23/006
See application file for complete search history.

(56) References Cited

U.S. PATENT DOCUMENTS 1,061,206 A 5/1913 Tesla
4,474,031 A 10/1984 Collet
(Continued)

FOREIGN PATENT DOCUMENTS

CN 103822420 A 5/2014
EP 2343489 A1 * 7/2011 ..... F04D 29/284
(Continued)

OTHER PUBLICATIONS

Machine translation for WO 2013004972 (Year: 2013).*
(Continued)

*Primary Examiner* — Joseph F Trpisovsky

(57) ABSTRACT

A refrigeration plant including: a first enclosure containing water in the liquid state at a temperature lower than or equal to the temperature of the triple point of water or higher than the temperature of the triple point of water by less than 10° C., and water in the gaseous state at a first pressure equal to the saturated vapor pressure of the water in equilibrium with the pressure of the water in the liquid state; a second enclosure at a second pressure strictly higher than the first pressure by a factor of at least two; a compression device connecting the first enclosure to the second enclosure; a condensing device adapted to condense the water in the gaseous state in the second enclosure into water in the liquid state; and a cold power extraction device for extracting cold power in the first enclosure.

16 Claims, 7 Drawing Sheets

(56) References Cited

U.S. PATENT DOCUMENTS

| | | | | |
|---|---|---|---|---|
| 5,520,008 | A * | 5/1996 | Ophir | F25B 1/053 416/185 |
| 6,328,527 | B1 | 12/2001 | Conrad et al. | |
| 6,688,117 | B1 * | 2/2004 | Ophir | F25C 1/16 62/74 |
| 2013/0256423 | A1 * | 10/2013 | Lord | F22B 35/00 237/2 A |
| 2017/0248355 | A1 * | 8/2017 | Knopp | F25B 31/026 |

FOREIGN PATENT DOCUMENTS

| | | | | |
|---|---|---|---|---|
| FR | 924606 | A | 8/1947 | |
| JP | S63269969 | | 11/1988 | |
| JP | 2004251541 | A * | 9/2004 | F25B 25/00 |
| JP | 2004251541 | A | 9/2004 | |
| JP | 2007278666 | | 10/2007 | |
| JP | 2011047618 | | 3/2011 | |
| WO | 0144665 | A1 | 6/2001 | |
| WO | 2012104787 | A1 | 8/2012 | |
| WO | 2012147366 | | 11/2012 | |
| WO | WO-2013004972 | A1 * | 1/2013 | F25B 1/10 |
| WO | 2015092730 | A1 | 6/2015 | |

OTHER PUBLICATIONS

Machine translation for EP 2343489 (Year: 2011).*

Machine translation for JP 2004251541 (Year: 2004).*

International Search Report for International Application No. PCT/FR2018/051907; Date of Completion: Nov. 5, 2018; dated Nov. 13, 2018; 4 Pages.

Written Opinion of the International Searching Authority for International Application No. PCT/FR2018/0519076; International Filing Date: Jul. 25, 2018; 9 Pages.

English Translation of International Search Report for International Application No. PCT/FR2018/051907; Date of Completion: Nov. 5, 2018; dated Nov. 13, 2018; 3 Pages.

English Translation of Written Opinion of the International Searching Authority for International Application No. PCT/FR2018/0519076; International Filing Date: Jul. 25, 2018; 8 Pages.

* cited by examiner

REFRIGERATION PLANT

CROSS REFERENCE TO RELATED APPLICATIONS

This application is a National Stage of PCT Application No. PCT/FR2018/051907 filed on Jul. 25, 2018, which claims priority of the French patent application FR17/57207 filed on Jul. 28, 2017, the contents each of which are incorporated herein by reference thereto.

FIELD

The present application concerns a refrigeration plant.

DISCLOSURE OF THE PRIOR ART

A refrigeration plant may be used in many different applications.

An example of the use of a refrigeration plant concerns an air-conditioning system, in particular in the context of an urban cooling network or for a data center.

Another example of the use of a refrigeration plant concerns a system for producing artificial snow, for example for the snow coverage of ski resorts in the case of light snowfall due to weather conditions or inherent to the geographical location of the resorts.

In general, for any thermomechanical energy converter, and in particular for a refrigeration plant, the ratio between the thermal power produced by the system (amount of hot heat $Q_{ch}$ or amount of cold heat $Q_{ref}$) and the work supplied to the system (work W) is called the coefficient of performance (COP). It is generally desirable that the COP be as high as possible, which translates into good energy efficiency of the system and induces low energy consumption, knowing that the energy consumption comprises the electric power consumption of the system.

There are different types of refrigeration plants which can be used in particular in systems for producing artificial snow. First systems for producing artificial snow are systems open to ambient air, of the snow gun or snow pole type, and generally implement the spraying of a mixture of water and air which crystallizes on contact with ambient air. The air may come from a source of compressed air whose expansion leads to the formation of snow. A drawback of these systems is that they can operate only over reduced temperature and hygrometry ranges, generally at a temperature below −2° C. and at a hygrometry above 30%. Second systems for producing artificial snow comprise open systems, as described in patent application WO2012/104787. The electric power consumption of such systems for producing snow generally varies from 20 kWh to 40 kWh per cubic meter of produced snow, which is lower than the second and third snow production systems. Nonetheless, such production systems require the construction of cooling towers and therefore have a construction cost that is too high for large-scale operation.

Third systems for producing artificial snow comprise closed systems of the refrigerator type including a compressor, a condenser, a regulator and an evaporator. A drawback is that the COP is generally low, generally in the range of 2 to 4. Furthermore, the electric power consumption of such snow production systems may be high, for example from 40 kWh to 120 kWh per cubic meter of produced snow.

Fourth systems for producing artificial snow comprise closed systems implementing cryogenic processes comprising in particular the formation of a mixture of water and a cryogenic gas, in particular nitrogen or carbon dioxide. Even though the COP of such a snow production system can be high, it is necessary to take into account the energy necessary for the production of the cryogenic fluid. As a result, the overall consumption of such snow production systems may be greater than several hundred kWh per cubic meter of produced snow, which results in an operating cost that is too high for a large-scale operation and considerable logistical constraints.

It would be desirable to provide a cold production installation, in particular for an air-conditioning system or for a system for producing artificial snow, having a high COP, in particular greater than 6, preferably greater than 10, and whose power consumption is low, in particular when the refrigeration plant is installed in a snow production system whose consumption is less than 5 kWh, preferably less than 3 kWh per cubic meter of produced snow. It would further be desirable for the refrigeration plant to be able to operate normally over a wide range of ambient temperatures, in particular at positive temperatures, and preferably up to 25° C., or even up to 35° C.

SUMMARY

Thus, an object of an embodiment is to at least partially overcome the drawbacks of the previously described refrigeration plants.

Another object of an embodiment is that the COP of the refrigeration plant is greater than 6, preferably greater than 10.

Another object of an embodiment is that the electric power consumption of the refrigeration plant is reduced, in particular, when the refrigeration plant is installed in a snow production system, less than 5 kWh per cubic meter of produced snow, preferably less than 3 kWh per cubic meter of produced snow.

Another object of an embodiment is that the refrigeration plant can operate at an ambient temperature comprised between −30° C. and +25° C., preferably between −30° C. and +35° C.

Another object of an embodiment is that the cost of construction of the refrigeration plant is reduced.

Thus, an embodiment provides a refrigeration plant comprising:

a first enclosure containing water in the liquid state at a temperature lower than or equal to the temperature of the triple point of water or higher than the temperature of the triple point of water by less than 10° C., preferably by less than 5° C., and water in the gaseous state at a first pressure equal, to within 10%, to the saturated vapor pressure of water in equilibrium with the pressure of water in the liquid state in the first enclosure, in particular equal, to within 10%, to the saturated vapor pressure of water at the temperature of the triple point of water;

a second enclosure at a second pressure strictly higher than the first pressure by a factor of at least two;

a compression device connecting the first enclosure to the second enclosure;

a condensing device partially housed in the second enclosure and adapted to condense the water in the gaseous state in the second enclosure into water in the liquid state; and a cold power extraction device for extracting cold power from the first enclosure.

According to one embodiment, the plant comprises a heating device for heating the water in the gaseous state in the first enclosure intended to supply the compression device.

According to one embodiment, the first enclosure further contains water in the solid state at a temperature lower than or equal to the temperature of the triple point of water.

According to one embodiment, the water circulates in a closed circuit in the plant.

According to one embodiment, the condensing device comprises a first heat exchanger outside the second enclosure and means for circulating a first heat-transfer fluid around the second enclosure throughout the first heat exchanger.

According to one embodiment, the first heat-transfer fluid is ambient air or water from a watercourse, a body of water or a water table.

According to one embodiment, the second pressure in the second enclosure is lower than or equal to 10000 Pa (100 mbar), preferably lower than or equal to 6000 Pa (60 mbar).

According to one embodiment, the cold power extraction device comprises a hydraulic circuit in which circulates part or all of the water in the liquid state present in the first enclosure, the hydraulic circuit comprising a second heat exchanger located outside the first enclosure.

According to one embodiment, the cold power extraction device comprises a closed hydraulic circuit in which circulates a second heat-transfer fluid, the hydraulic circuit comprising a second heat exchanger located outside the first enclosure and a third heat exchanger heat disposed in the first enclosure.

According to one embodiment, the refrigeration plant comprises a third enclosure in which is located the second heat exchanger delivering cold power to the end user, the third enclosure containing for example water in the solid state.

According to one embodiment, the heating device comprises a source of infrared radiation and/or a source of microwave radiation.

According to one embodiment, the heating device is adapted to heat the water in the gaseous state in the first enclosure intended to supply the compression device by at least 2° C., preferably by at least 10° C., more preferably by at least 20° C.

According to one embodiment, the compression device comprises at least one turbo-type compressor, in particular a centrifugal compressor and/or an axial compressor.

According to one embodiment, the compression device comprises a series of stages, each stage comprising a rotor and a stator.

According to one embodiment, the compression device is a Tesla compressor.

According to one embodiment, the compression device comprises a first compressor stage with a fixed compression ratio and a second compressor stage with a controllable compression ratio.

According to one embodiment, the refrigeration plant further comprises, in the first enclosure, a mechanical device for protecting the compression device against the admission of particles in the solid and/or liquid state.

According to one embodiment, the refrigeration plant comprises a pipe for supplying water in the liquid state in the first enclosure.

According to one embodiment, the condensing device comprises at least one nozzle for projecting droplets of water in the liquid state in the second enclosure.

According to one embodiment, the plant further comprises a system for regulating the pressure difference between the second enclosure and the first enclosure.

According to one embodiment, the regulation system comprises an expansion turbine configured to expand water in the gaseous state from the second enclosure and discharge a mixture containing water in the gaseous state and water in the liquid state in the first enclosure.

According to one embodiment, the first enclosure comprises at least one reservoir of water in the liquid state and in which said mixture is discharged into the water in the liquid state contained in said reservoir.

An embodiment also provides a system for producing artificial snow comprising a refrigeration plant as previously defined.

An embodiment also provides an air-conditioning system intended for industrial, collective and private plants comprising a refrigeration plant as previously defined, in particular as part of an urban cooling network or for a data center.

An embodiment also provides a method for producing cold comprising the following steps of:

bringing in a first enclosure water in the liquid state at a temperature lower than or equal to the temperature of the triple point of water or higher than the temperature of the triple point of water by less than 10° C., preferably lower than 5° C., and forming water in the gaseous state at a first pressure equal, to within 10%, to the saturated vapor pressure of the water in equilibrium with the pressure of the water in the liquid state in the first enclosure, in particular equal, to within 10%, to the saturated vapor pressure of the water;

compressing water in the gaseous state from the first enclosure to a second enclosure at a second pressure strictly higher than the first pressure by a factor of at least two;

condensing the water in the gaseous state in the second enclosure into water in the liquid state; and extracting cold power from the first enclosure.

According to one embodiment, the method further comprises the step of heating the water in the gaseous state in the first enclosure intended to be compressed.

BRIEF DESCRIPTION OF THE DRAWINGS

These features and advantages, as well as others, will be explained in detail in the following description of particular embodiments made without limitation in connection with the appended figures among which.

DETAILED DESCRIPTION

Figure 1:
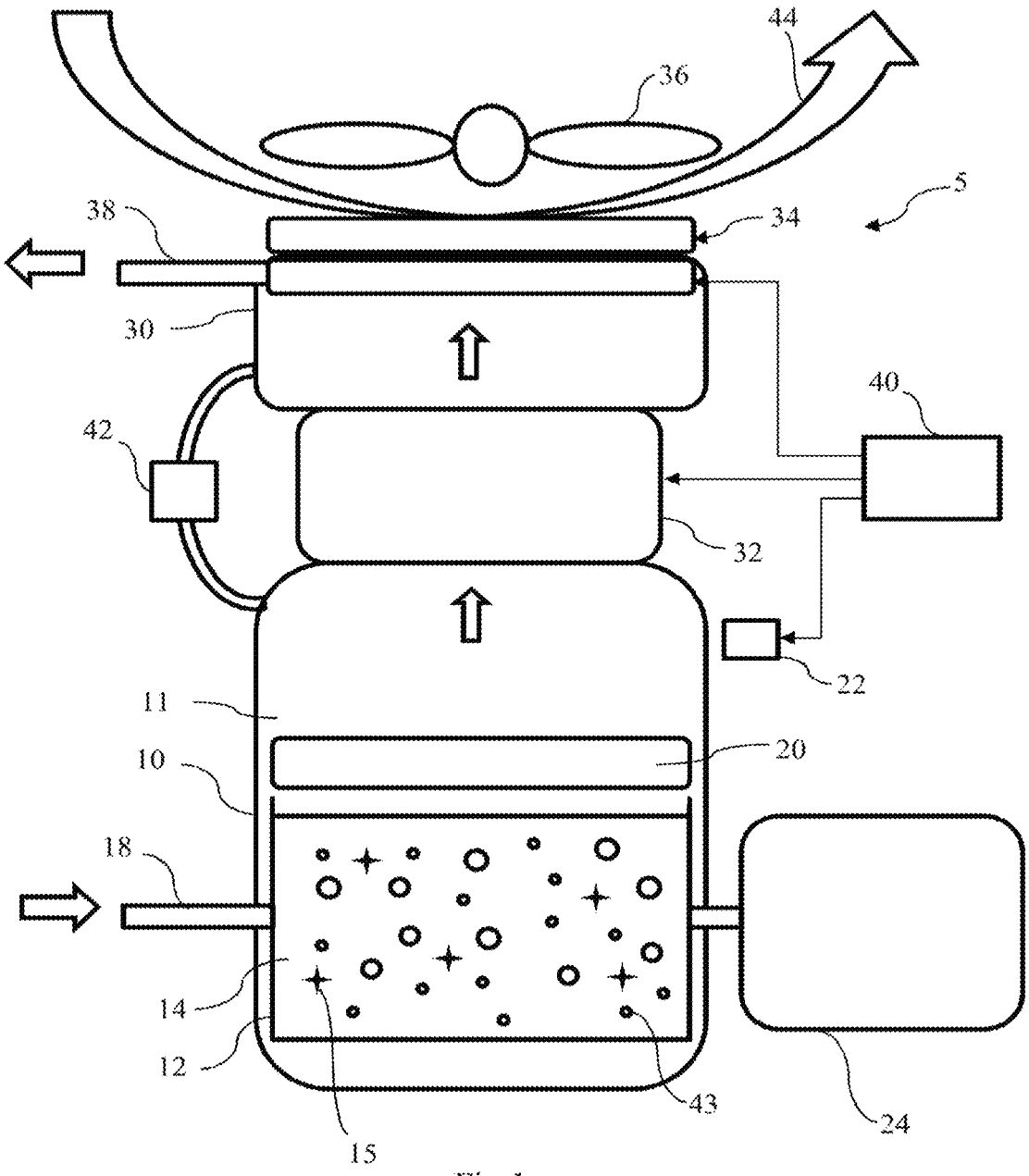
FIG. 1 is a partial and schematic sectional view of an embodiment of a refrigeration plant.

For clarity, the same elements have been designated by the same reference numerals in the different figures and, in addition, the various figures are not plotted to scale. Furthermore, only the elements useful for understanding the present description have been represented and are described. In particular, compressors and heat exchangers are well known to those skilled in the art and are not described in detail. In the following description, when referring to relative position qualifiers, such as "above", "below", "upper", "lower", etc., or to orientation qualifiers, such as the terms "horizontal", "vertical", etc., reference is made to the orientation of the figures or to a refrigeration plant in a normal position of use. In the following description, unless otherwise indicated, the terms "substantially", "about", "approximately" and "in the range of" mean "to within 10%", preferably "to within 5%".

In the remainder of the application, the chemical compound $H_2O$, which can be in the liquid, solid or gaseous state, is called "water". Furthermore, the expressions "water in the gaseous state" or "water vapor" are used interchangeably thereafter. In the remainder of the application, the expression "liquid water" or "water in the liquid state" is used to designate either pure water in the liquid state or water in the liquid state corresponding to the solvent of an aqueous solution further containing at least one solute. Furthermore, in the following description, the expression "triple point of water" means "triple point of pure water".

Embodiments of refrigeration plants using water in the liquid state will now be described. It is clear that, in these embodiments, the water in the liquid state may correspond to the solvent of an aqueous solution, that is to say that additives may be added to the water in the liquid state.

FIG. 1 represents an embodiment of a refrigeration plant 5.

The refrigeration plant 5 comprises:

a first low-pressure enclosure 10, gas tight with respect to the external environment and thermally insulated with respect to the external environment, the first low-pressure enclosure 10 containing, in operation, essentially water vapor 11;

a reservoir 12 containing liquid water 14, and, when operating in the stationary mode of the refrigeration plant 5, water in the solid state 15, the reservoir 12 being located in the first low-pressure enclosure 10 and being open onto the inner volume of the first low-pressure enclosure 10;

a pipe 18 for supplying liquid water to the reservoir 12;

a protective element 20, housed in the first low-pressure enclosure 10, covering the free surface of the liquid water 14 and preventing the projection of splashes of liquid water out of the reservoir 12;

at least one heating device 22 for heating at least one portion of the water vapor in the first enclosure 10 at low pressure;

a cold power extraction device 24 for extracting cold power from the reservoir 12, for example a device for recovering water in the solid state connected to the reservoir 12;

a second low-pressure enclosure 30, gas tight with respect to the external environment and thermally insulated with respect to the external environment, the pressure in the second low-pressure enclosure 30 being higher than the pressure in the first low-pressure enclosure 10;

a compressor 32, also called a compression device, for example a turbo-compressor, a turbine or a Tesla compressor, connecting the first enclosure 10 at low pressure to the second low-pressure enclosure 30, receiving strictly water vapor from the first low-pressure enclosure 10 and supplying compressed water vapor to the second low-pressure enclosure 30;

a condensing device 34, also called condenser 34, adapted to liquefy the water vapor present in the second low-pressure enclosure 30, the condenser 34 being partly housed in the second low-pressure enclosure 30 and comprising for example a heat exchanger cooled by ambient air, the condenser 34 comprising means, for example a fan 36, for circulating ambient air throughout the heat exchanger;

a pipe 38 for recovering the liquid water produced by the condenser 34; and a processing module 40 connected to the heating device 22, to the compressor 32 and to the condenser 34 and adapted to control the heating device 22, the compressor 32 and the condenser 34.

When the refrigeration plant 5 operates in open cycle, the liquid water 14 contained in the reservoir 12 may be water coming directly from the running water, or fresh water, distribution system, in particular water from a waterway or water from a hill water dam. In the case where the refrigeration plant 5 operates in a closed cycle, the pipe 38 may be connected to the pipe 18. The refrigeration plant 5 may further comprise a system 42 for regulating the pressure difference between the second low-pressure enclosure 30 and the first low-pressure enclosure 10. The system 42 may correspond to a controlled valve system, to a capillary system, to an expansion turbine system or to a spillway system, and is adapted to maintain the pressure difference between the second low-pressure enclosure 30 and the first low-pressure enclosure 10 at a substantially constant value.

The processing module 40 may correspond to a dedicated circuit or may comprise a processor, for example a microprocessor or a microcontroller, adapted to execute instructions of a computer program stored in a memory. The refrigeration plant 5 may further comprise sensors, in particular temperature sensors, pressure sensors, level sensors, flow rate sensors, etc., not represented, connected to the processing module 40, in particular for the detection of temperature and pressure in the enclosures 10 and 30.

According to one embodiment, the compressor 32 is an axial compressor or a centrifugal compressor which provides a flow of compressed vapor substantially along the axis of rotation of the compressor. The compressor comprises a series of compression stages, each stage comprising a rotor and a stator. The rotor comprises blades driven in rotation by a transmission shaft. The rotor accelerates the gas flow thanks to the energy transmitted by the transmission shaft of the compressor. The stator comprises fixed blades. The stator transforms the kinetic energy of the gas flow into pressure via the shape of the stator.

The heating device 22 is preferably a radiation heating device, comprising a source of electromagnetic radiation reaching the water vapor. The heating device 22 comprises for example a system for heating the water vapor by infrared or for example a system for heating the water vapor by microwave. According to one embodiment, the heating device 22 comprises both a source of infrared radiation and a source of microwave radiation. Depending on the considered application, the heating device 22 may not be present.

The dimensions of the refrigeration plant 5 depend on the intended application. The volume of the first low-pressure enclosure 10 may be comprised between 1 l and several thousand cubic meters, in particular between 10 l and 10000 l. The volume of the second low-pressure enclosure 30 may be comprised between 1 l and one thousand cubic meters, in particular between 1 l and 10000 l. The volume of liquid water 14 in the reservoir 12 may be comprised between 1 l and several thousand cubic meters, in particular between 1 l and 3000 $m^3$, in particular between 9 l and 9999 l.

The refrigeration plant 5 comprises a primary vacuum pump, not represented, connected to the first low-pressure enclosure 10 and/or to the second low-pressure enclosure 30.

Figure 2:
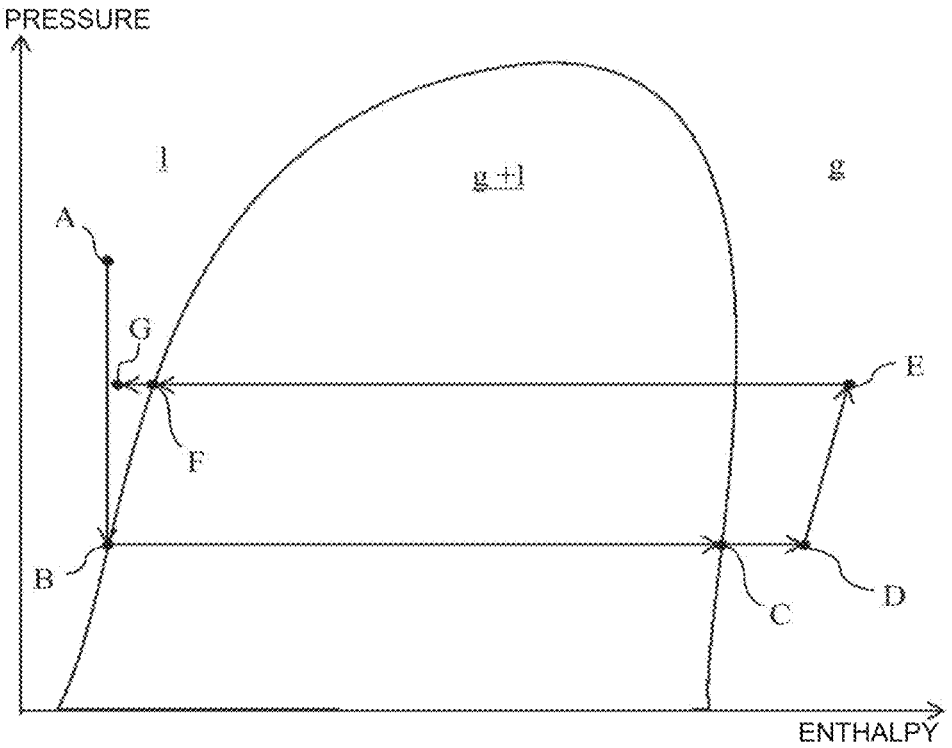
FIGS. 2 to 4 represent enthalpy-pressure water diagrams illustrating the operation of the refrigeration plant represented in FIG. 1.

FIG. 2 represents an enthalpy-pressure diagram of water illustrating the operation of the refrigeration plant 5 at the start of its operation.

The points referenced A to G in FIG. 2 illustrate successive states through which water circulating in the refrigeration plant 5 passes.

The point A represents liquid water which will be introduced into the reservoir 12 via the pipe 18, for example to fill the reservoir 12 at the start of operation of the plant 5. The pressure of the liquid water at point A is at a first pressure value and the temperature of the liquid water at point A is at a first temperature value. According to one embodiment, the first pressure value is higher than or equal to 0.1 MPa (1 bar), for example higher than or equal to 0.1 MPa (1 bar) and lower than or equal to 10 MPa (100 bar). According to one embodiment, the first temperature value is higher than or equal to 5° C., for example higher than or equal to 5° C. and lower than or equal to 10° C. The water brought into the reservoir 12 comes for example from a water distribution network to which the refrigeration plant 5 is connected. The first temperature value may then correspond to the temperature of the water supplied by the distribution network.

Once introduced into the reservoir 12, the pressure of the liquid water 14 decreases from the first pressure value to the pressure in the first low-pressure enclosure 10 which is at a second pressure value. This corresponds to the transition from point A to point B. In operation, the second pressure value is equal to the saturated vapor pressure of the liquid water 14 present in the reservoir 12. According to one embodiment, the second value of pressure in the first low-pressure enclosure 10 is typically comprised between 600 Pa (6 mbar) and 2500 Pa (25 mbar), preferably between 600 Pa (6 mbar) and 1500 Pa (15 mbar). For example, for water at 5° C., the pressure in the first low-pressure enclosure 10 may be equal to 870 Pa (8.7 mbar). The temperature of the liquid water introduced into the reservoir 12 during the pressure drop remains substantially constant and equal to the first temperature value.

The temperature of the liquid water 14 in the reservoir 12 is at a second temperature value. At the start of the operation of the refrigeration plant 10, the second temperature value is substantially equal to the first temperature value so that the temperature of the water introduced into the reservoir 12 and whose pressure has decreased does not substantially vary.

A portion of the liquid water 14 in the reservoir 12 will be evaporated which will bring the water from the first temperature value to the second temperature value. This corresponds to the transition from point B to point C. As the pressure in the low-pressure enclosure 10 is equal to the saturated vapor pressure of water at the second temperature value, the vaporization is a boiling of the liquid water 14 which in particular comprises the formation of bubbles 43 (see FIG. 1) in the liquid water 14. There is then obtained, in the first low-pressure enclosure 10, water vapor at the second temperature value and at the second pressure value. The protective element 20 makes it possible to prevent splashes of liquid water from reaching the compressor 32 or liquid water from spilling out of the reservoir 12 during the boiling of the liquid water 14. The protective element 12 can, further, make it possible to increase the exchange surface by comprising portions penetrating into the liquid water.

According to one embodiment, all or part of the water vapor in the first low-pressure enclosure 10 is heated by the heating device 22. The temperature of a portion of water vapor in the first low-pressure enclosure 10 then changes from the second temperature value to a third temperature value. According to one embodiment, the water vapor is pumped by the compressor 32 into the portion of the first enclosure 10 where it is heated. This corresponds to the transition from point C to point D. According to one embodiment, the third temperature value is higher than or equal to 0° C. and lower than or equal to 100° C. Preferably, the third temperature value is higher than the second temperature value by at least 2° C., preferably by at least 10° C., more preferably by at least 20° C. The pressure of the water vapor during the heating step does not substantially vary and remains substantially equal to the second pressure value. The use of the heating device 22 by radiation makes it possible to heat all the water vapor that supplies the compressor 32. Indeed, it would be difficult with a heating device by conduction or convection to heat all the water vapor that supplies the compressor 32 due to the low pressure and consequently the too low material density in the first low-pressure enclosure 10.

The water vapor heated to the third temperature value supplies the compressor 32 which delivers the compressed water vapor in the second low-pressure enclosure 30. This corresponds to the transition from point D to point E. According to one embodiment, the compression ratio of the compressor 32 is greater than or equal to 2 and for example less than or equal to 14. The pressure in the second low-pressure enclosure 30 is equal to a third pressure value higher than the second pressure value by a factor of at least 2. For example, the third pressure value is higher than or equal to 600 Pa (6 mbar) and lower than or equal to 10000 Pa (100 mbar), preferably lower than or equal to 6000 Pa (60 mbar). For example, when the second pressure value is equal to 870 Pa (8.7 mbar) and the compression ratio of the compressor 32 is equal to 2, the third pressure value is substantially equal to 1740 Pa (17.4 mbar). The compression of the water vapor by the compressor 32 causes the water vapor to heat up, whose temperature goes from the third temperature value to a fourth temperature value, higher than the third temperature value.

The water vapor compressed in the low-pressure enclosure 30 is cooled and then liquefied in liquid water cooled by the condenser 34. This corresponds to the transition from point E to point F and to the transition from point F to point G. The water pressure during the cooling and liquefaction step does not substantially vary and remains equal to the third pressure value. The water temperature varies from the fourth temperature value to a fifth temperature value strictly lower than the fourth temperature value. For example, for a third pressure value equal to 1740 Pa (17.4 mbar), the fifth temperature value may be equal to 15.3° C. The higher the compression ratio, the more it is possible to condense water with high outside temperatures and the faster the condensation can be carried out.

The liquid water produced by the condenser 34 is discharged from the reservoir 30 at low pressure via the pipe 38. In the case of a closed cycle, the pipe 38 is connected to the pipe 18 so that the liquid water removed from the enclosure 30 is returned to reservoir 12.

Condensation causes vacuum pumping, related to the difference in mass volume between liquid water and gaseous water (ratio of about 1600 to 200000 between the liquid and gaseous phases), which maintains a vacuum level in the enclosures 10 and 30. Maintaining the pressure difference between the low-pressure enclosure 30 and the low-pressure enclosure 10 is achieved by the processing module 40 which for this purpose controls the heating device 22, the compressor 32, the condenser 34, the system 42 and possibly the primary vacuum pump.

The primary vacuum pump operates at the start of the refrigeration plant 5 until the pressure in the first low-pressure enclosure 10 reaches the saturated vapor pressure at the first temperature value. The vacuum pump may then be stopped and the pressure in the enclosure 10 is maintained by the vacuum generated at the level of the condenser 34 and the mechanical work of the compressor 32. The vacuum pump may further participate, where necessary, in maintaining the pressure in the first low-pressure enclosure 10.

Figure 3:
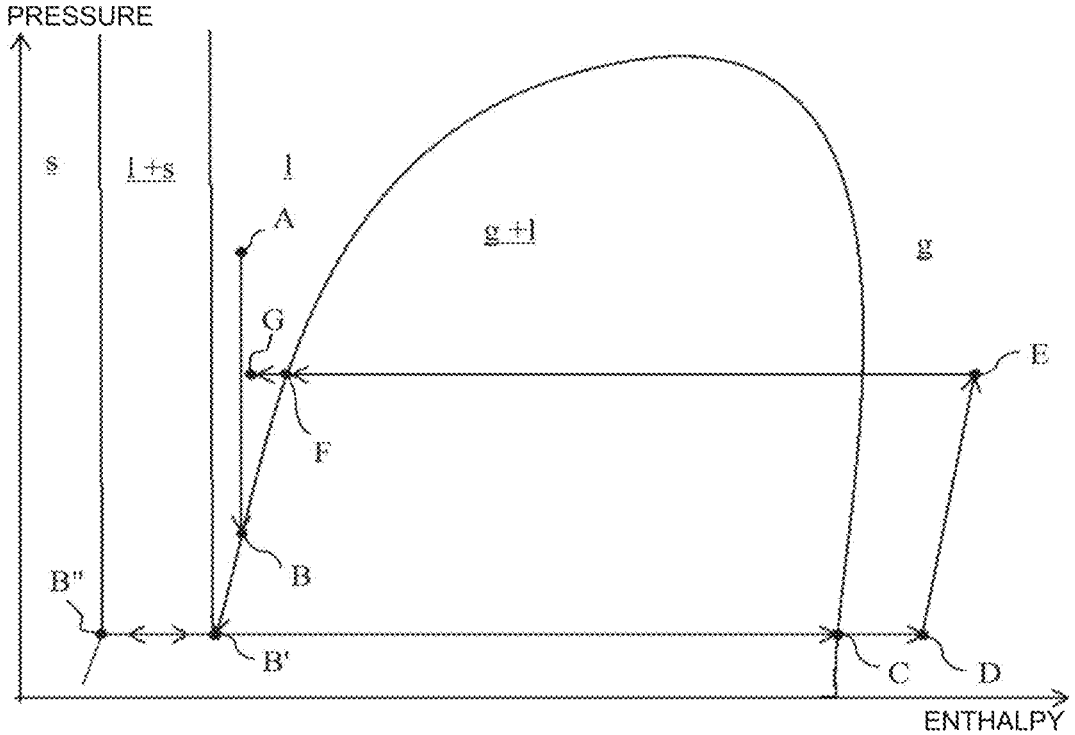
Figure 4:
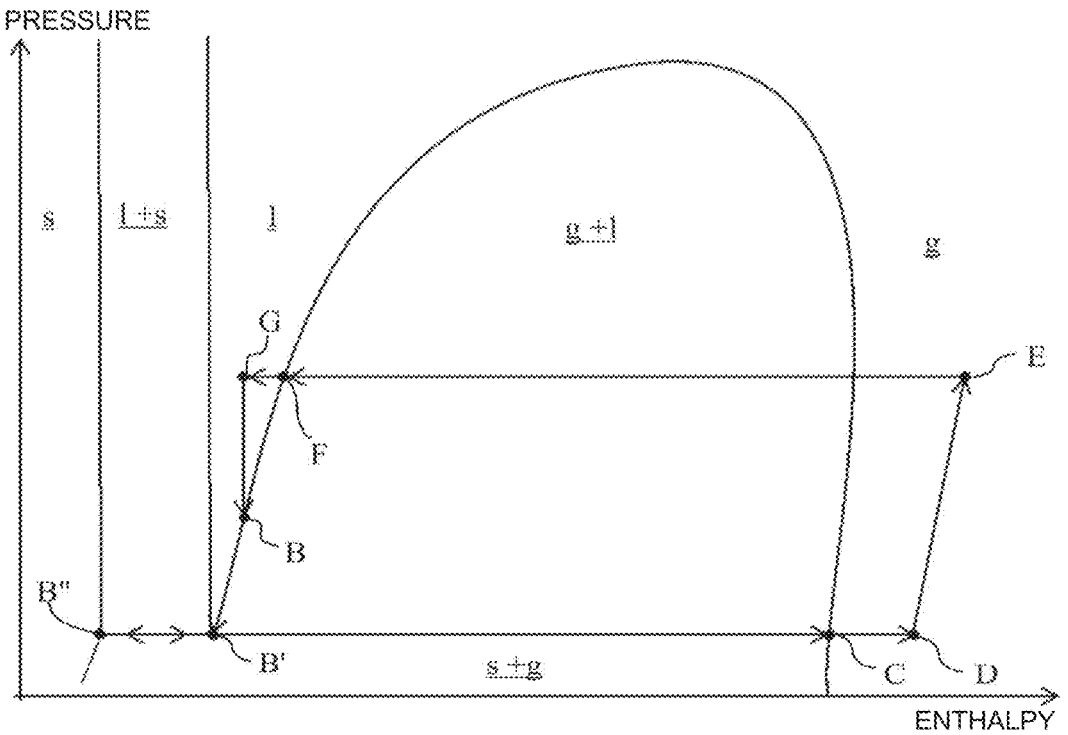

FIGS. 3 and 4 each represent an enthalpy-pressure diagram of the water illustrating the operation of the refrigeration plant 5 in stationary regime respectively for an open cycle and for a closed cycle.

In the stationary mode, the reservoir 12 is filled with liquid water 14. Additional water is supplied by the pipe 18 in the reservoir 12 to compensate for the losses of liquid water from the reservoir 12, for example continuously or intermittently. In the case of an open cycle, the additional water is at point A (FIG. 3). In the case of a closed cycle, the additional liquid water comes from the condensates recovered in the enclosure 30 and is therefore at point G.

During the previously described evaporation of the liquid water 14 from the reservoir 12, the heat necessary to produce water vapor is extracted from the liquid water 14 since the first low-pressure enclosure 10 is thermally insulated from the external environment. A cooling of the liquid water 14 in the reservoir 12 is thus obtained. This is shown in FIGS. 3 and 4 by an additional state represented by the point B' in the series of states followed by water circulating in the plant 5. Indeed, when water is introduced into the reservoir 12 at the first temperature value and at the first pressure value for an open cycle (point A in FIG. 3) and at the fifth temperature value and third pressure value for a closed cycle (point G in FIG. 4), there is a decrease in the pressure of this water at the second pressure value, corresponding to the transition from point A to point B, and a decrease in the water temperature from the first temperature value to the second temperature value, strictly lower than the first temperature value, corresponding to the transition from point B to point B'.

The pressure in the first low-pressure enclosure 10 decreases simultaneously with the decrease in the temperature of the liquid water 14 of the reservoir 12 to remain equal to the saturated vapor pressure at the temperature of the liquid water 14 in the reservoir 12. Maintaining the pressure in the enclosure 10 at the saturated vapor pressure at the temperature of the liquid water 14 in the reservoir 12 is achieved by the processing module 40 which for this purpose controls the heating device 22, the compressor 32 and the condenser 34, the system 42 and possibly the primary vacuum pump.

According to one embodiment, the temperature of the liquid water 14 in the reservoir 12 decreases until reaching the temperature of the triple point of water, which, as example, for a pressure of 611 Pa (6.11 mbar) is equal to 0.01° C. Ice crystals 15 are then formed in the reservoir 12, which corresponds to the transition between points B' and B" in FIGS. 3 and 4. According to an one embodiment, in the stationary mode, the temperature of the liquid water 14 in the reservoir 12 remains substantially constant and equal to the temperature of the triple point of pure water and the pressure in the first low-pressure enclosure 10 is substantially equal to the saturated vapor pressure at the temperature of the triple point of water. According to another embodiment, when water stirring means are provided or when suitable additives are added to the water, in the stationary mode, the temperature of the liquid water 14 in the reservoir 12 remains substantially constant and equal to a temperature below the temperature of the triple point of pure water and the pressure in the first low-pressure enclosure 10 is substantially equal to the saturated vapor pressure of the water in equilibrium with the pressure of water in the liquid state at the temperature below the temperature of the triple point of water. Water is then present in the first low-pressure enclosure 10 simultaneously in the gaseous state, in the liquid state and in the solid state. According to another embodiment, in particular when the refrigeration plant is used in an air-conditioning system, the temperature of the liquid water 14 in the reservoir 12 decreases to a temperature higher than the temperature of the triple point of water by less than 10° C., preferably by less than 5° C. Water is then present in the first low-pressure enclosure 10 simultaneously in the gaseous state and in the liquid state.

In summary, the evaporation of a mass $M_{ev}$ of water will contribute to cooling the mass $M_{liq}$ of water remaining at the second temperature value, then to solidifying a mass $M_{sol}$ of water, possibly zero, which is then transformed into ice according to the following relationship (1):

$$M_{ev}*L_{ev}=M_{liq}*C_p*\Delta\theta+M_{sol}*L_{sol} \quad (1)$$

where $L_{ev}$ is the latent heat of evaporation of water, $C_p$ is the heat capacity of liquid water, $\Delta\theta$ is the difference between the first and second temperature values, and $L_{sol}$ is the latent heat of solidification of water.

In the case where water in the solid state is produced, at the end of the cycle, an ice mass $M_{sol}$ can be obtained according to the following relationship (2):

$$M_{ev}*L_{ev}=M_{sol}*(C_p*\Delta\theta+L_{sol}) \quad (2)$$

The other water state transitions are the same as those previously described in connection with FIG. 2. In particular, the heating step which corresponds to the transition between points C and D aims at increasing the temperature of the water vapor in the low-pressure enclosure 10 by at least 2° C., preferably by at least 10° C., preferably by at least 20° C. Furthermore, during the decrease in the temperature of the liquid water 14 in the reservoir 12, the compression ratio of the compressor 32 can be adjusted to substantially maintain the same third pressure value in the second low-pressure enclosure 30. For example, when the second pressure value in the first low-pressure enclosure 10 is equal to 611 Pa (6.11 mbar), the compression ratio of the compressor 32 is for example equal to 3 and the third value of pressure in the second low-pressure enclosure 30 is equal to 1830 Pa (18.3 mbar). For example, the fifth value of the temperature of the liquid water produced by the condenser 34 at 1830 Pa (18.3 mbar) is for example equal to 16.05° C. for an ambient temperature of about 6° C.

According to one embodiment, the cold power extraction device 24 removes the ice crystals 15 as they are formed in the reservoir 12. The subsequent use of the ice crystals depends on the intended application.

For an application for the production of artificial snow, the ice crystals 15 are recovered to produce artificial snow. A refrigeration plant may be provided to lower the temperature of the recovered ice and/or a pumping unit to evaporate the residual water and thus cool and dry the ice. There may further be provided a device for chopping and ventilating the produced ice.

For an application for air-conditioning or refrigeration and for the production of artificial snow, the ice crystals 15 present in the reservoir 12 can act as a cold source.

The condenser 34 is adapted to liquefy the water vapor in the second low-pressure enclosure 30 by a heat exchange between the water vapor in the second low-pressure enclosure 30 and a refrigerating fluid. According to one embodiment, the refrigerating fluid is the air outside the refrigeration plant 5. The condenser 34 may comprise means for stirring the air, for example the helical fan 36 as represented in FIG. 1, the air stirring being schematically represented by the arrow 44. Alternatively, the condenser 34 may comprise a Venturi effect fan or a thermosiphon. According to another embodiment, the condenser 34 may comprise a liquid-water vapor exchanger group in the enclosure 30 and a liquid-air or liquid/liquid exchanger group outside the enclosure 30, the cooling fluid circulating between these two exchangers.

Advantageously, the condensation of water in the enclosure 30 does not require the implementation of a refrigerating machine.

The production of liquid water by the condenser 34 may be carried out by using ambient air as soon as the temperature of the ambient air is lower than the fifth of the desired temperature value. In the previously described example in which the condenser 34 produces liquid water at 16.05° C., the ambient air may be used as soon as its temperature is below 16° C., preferably below 6° C. to obtain a temperature difference of at least 10° C. on the exchanger.

The maximum possible temperature of the ambient air enabling a use of the ambient air as a refrigerating fluid by the condenser 34 is in particular set by the compression ratio of the compressor 32. With a compression ratio of 10, it may be considered a saturated vapor pressure of 6000 Pa (60 mbar) in the second low-pressure enclosure 30 and a fifth temperature value of 36° C., which can be obtained without difficulty as soon as the ambient air temperature is below 30° C. Preferably, the refrigeration plant 5 can be used as soon as the ambient temperature is below 20° C. for the production of artificial snow and below 35° C. for air-conditioning.

According to one embodiment, the theoretical COP of the refrigeration plant 5 is in the range of 19 to 20.

Table I hereinbelow groups, for an application to the production of artificial snow, and as a function of the temperature of ambient air, the power consumption, expressed in kilowatt per cubic meter of produced snow, of the refrigeration plant 5 (INV) represented in FIG. 1, of a snow cannon type plant (AA1), of a snow pole type plant (AA2), of a low-pressure evaporation plant (AA3) between 0.01 MPa (100 mbar) and 0.02 MPa (200 mbar) and of a refrigerator-type plant (AA4).

TABLE I

| Ambient temperature (° C.) | INV | AA1 | AA2 | AA3 | AA4 |
|---|---|---|---|---|---|
| −10 | 1.6 | 2 | 1.9 | 24 | 40 |
| −5 | 1.7 | 3.1 | 2.5 | 25.5 | 41.5 |
| 0 | 1.85 | 5.4 | 3 | 27 | 43 |
| 10 | 2.3 | NA | NA | 28.5 | 44.5 |

The power consumption per cubic meter of snow produced by the refrigeration plant 5 (INV) is much lower than that of refrigeration plants of the refrigerator type (AA4) and with low-pressure evaporation between 0.01 MPa (100 mbar) and 0.02 MPa (200 mbar) (AA3).

According to one embodiment, the liquid water supplied by the condenser 34 is not reused. According to another embodiment, the water supplied by the condenser 34 is reused to supply the reservoir 12.

Figure 5:
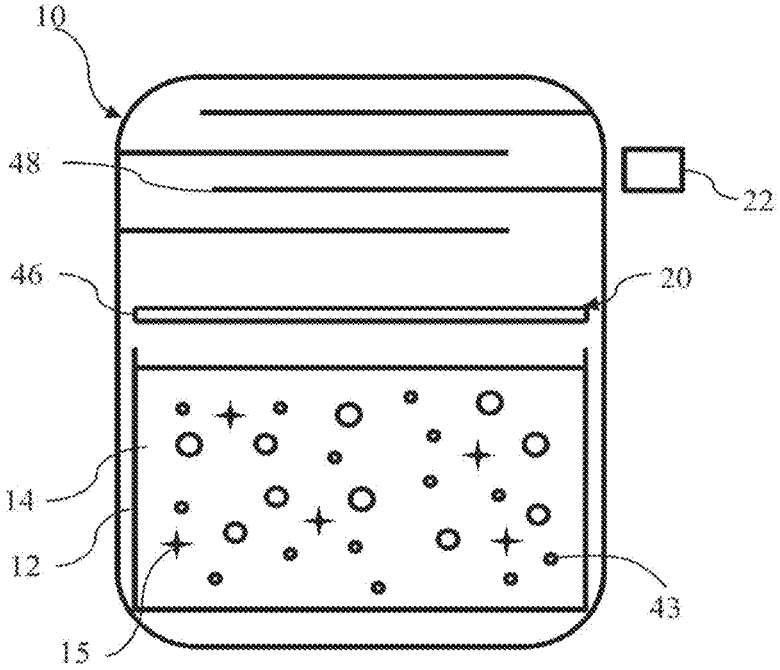
FIG. 5 is a partial and schematic sectional view of a more detailed embodiment of a portion of the refrigeration plant of FIG. 1.

FIG. 5 is a partial and schematic view of a more detailed embodiment of the low-pressure reservoir 10 of the refrigeration plant 5 of FIG. 1.

According to one embodiment, the protective element 20 comprises a diaphragm or a screen 46 covering the free surface of the liquid water 14. The diaphragm or the screen 46 is permeable to water vapor and substantially tight to liquid water. The protective element 20 may further comprise elements immersed in the liquid water 14, not represented, and which make it possible to regulate the generation of bubbles 43 during the boiling of the liquid water 14.

According to one embodiment, baffles 48 may be disposed in the portion of the enclosure 10 in which the water vapor is heated by the heating device 22. The baffles 48 make it possible to lengthen the path of the water vapor up to the inlet of the compressor 32 to obtain the heating of the water vapor to the desired temperature.

Figure 6:
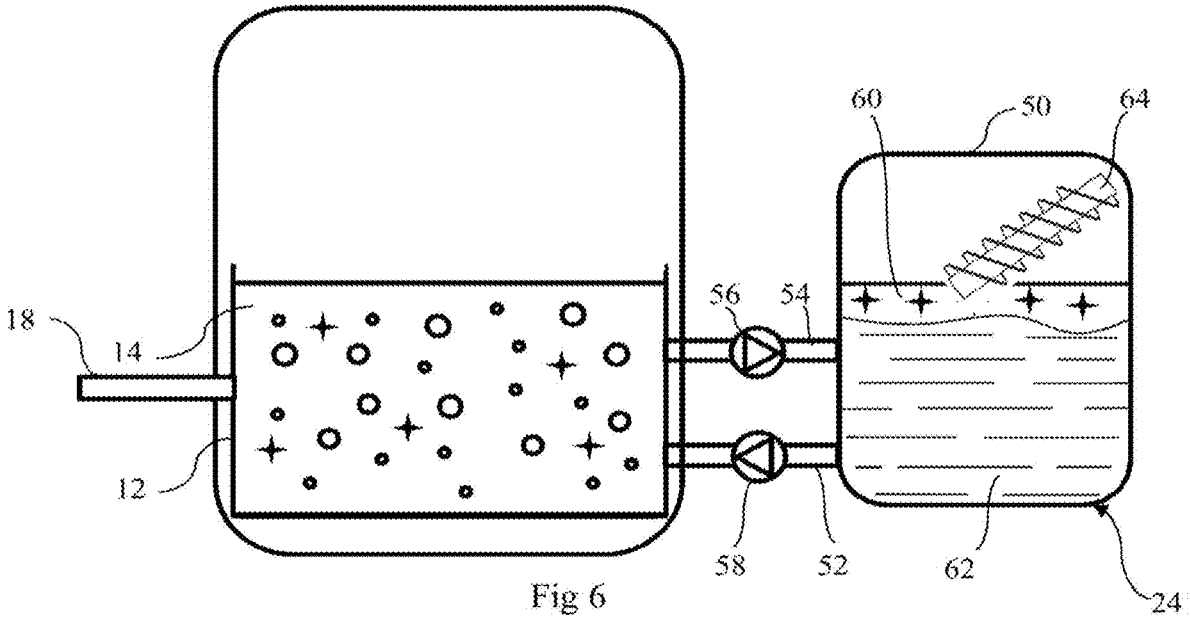
FIGS. 6 and 7 are partial and schematic sectional views of more detailed embodiments of another portion of the refrigeration plant of FIG. 1.

FIG. 6 is a partial and schematic sectional view of a more detailed embodiment of the device 24 for recovering water in the solid state of the refrigeration plant 5.

In the present embodiment, the device 24 is adapted to extract the water in the solid state from the reservoir 12. Such an embodiment is adapted in particular in the case where the refrigeration plant 5 is used for the production of artificial snow.

The device 24 may comprise a secondary enclosure 50 connected to the reservoir 12 by a bottom pipe 52 and a top pipe 54, located above the bottom pipe 52. A pump 56 provided on the top pipe 54 is adapted to circulate the contents from the reservoir 12 to the secondary enclosure 50 and a pump 58 provided on the bottom pipe 52 is adapted to circulate the contents of the secondary enclosure 50 to the reservoir 12. The pressure in the secondary enclosure 50 may be higher than in the reservoir 12, for example equal to the atmospheric pressure, so that there is no boiling in the secondary enclosure 50. The ice crystals are then accumulated above the liquid water 62 by decantation into a floating mass of ice 60. The device 24 comprises means 64 for extracting the ice crystals 60, comprising for example a worm screw or a bucket elevator.

Figure 7:
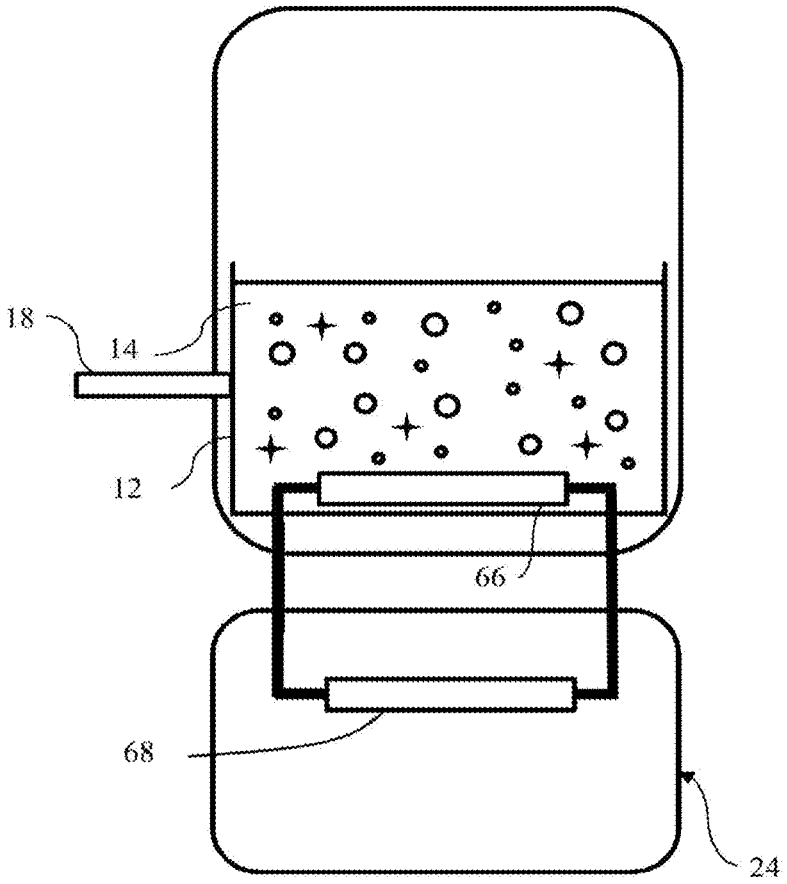

FIG. 7 is a sectional, partial and schematic view of another more detailed embodiment of the device 24. The device 24 may be part of an air-conditioning or refrigeration plant, and may comprise a closed circuit in which a refrigerating fluid circulates and comprising a first heat exchanger 66 disposed in the reservoir 12 and a second heat exchanger 68 located outside the enclosure 10. According to another embodiment, the first heat exchanger 66 is not present and the liquid circulating in the heat exchanger 68 corresponds to the liquid water 14 present in the reservoir 12.

Figure 8:
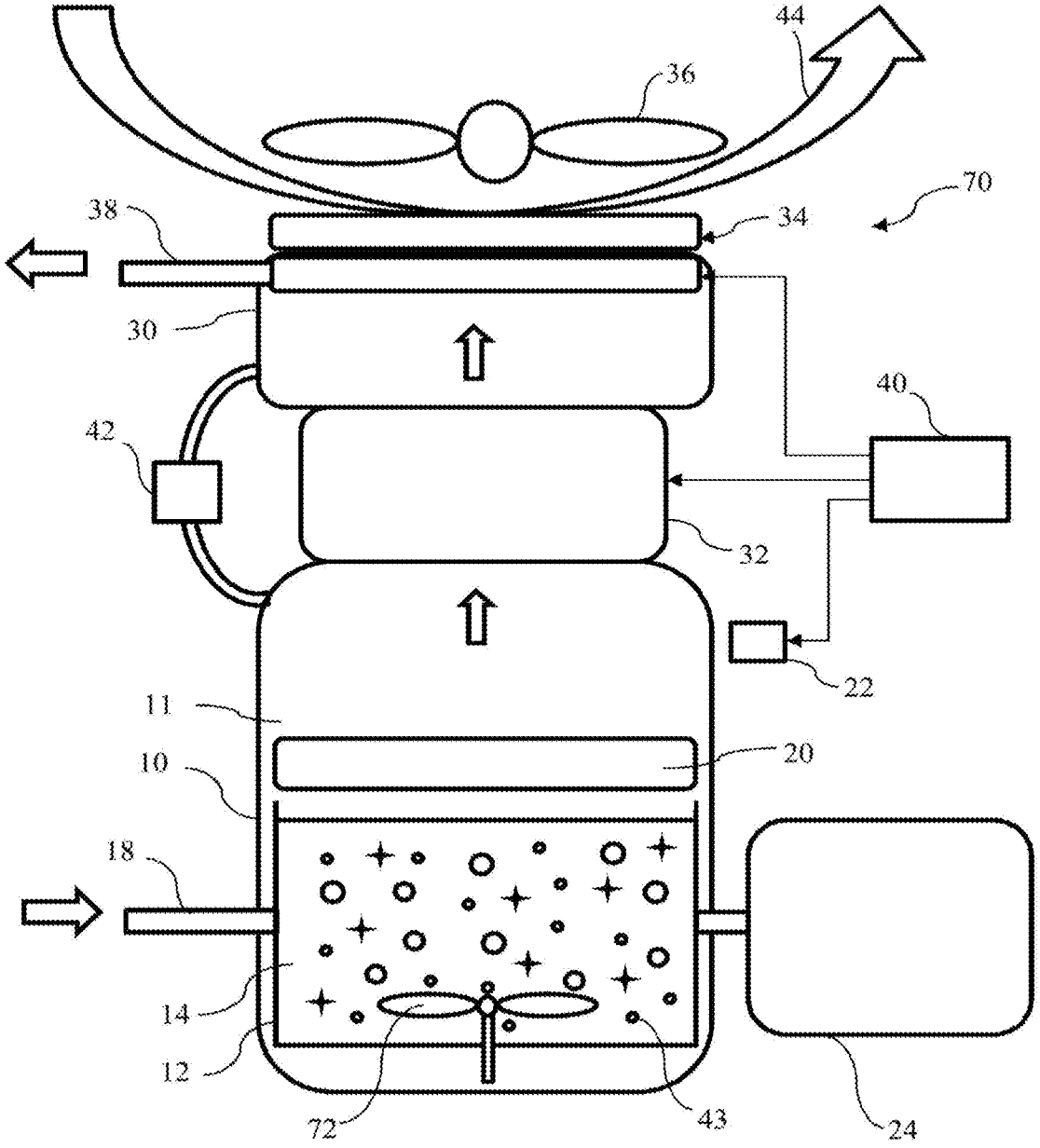
FIG. 8 is a partial and schematic sectional view of another embodiment of a refrigeration plant.

FIG. 8 is a partial and schematic sectional view of an embodiment of a refrigeration plant 70. The refrigeration plant 70 comprises all the elements of the refrigeration plant 5 represented in FIG. 1 with the difference that it further comprises means for maintaining the liquid water in supercooling in the first low-pressure enclosure 10. According to one embodiment, the means for maintaining the liquid water in supercooling may comprise an stirrer 72 adapted to brew the water in the liquid state in the first low-pressure enclosure 10. The stirrer 72 comprises for example a bar or a propeller rotated in the water in the liquid state 14. According to another embodiment, the means for maintaining the liquid water in supercooling may comprise at least one additive added to the water in a liquid state. This additive mixed with water leads to a solution whose solidification temperature is lower than the solidification temperature of additive-free water.

In the present embodiment, the temperature of the liquid water 14 in the first low-pressure enclosure 10 may be lower than the temperature of the triple point of water, and is for example at a temperature which may vary from −40° C. to 1° C., preferably from −20° C. to −1° C. The operation of the refrigeration plant 70 is identical to the operation previously described for the refrigeration plant 5 with the difference that the temperature of the liquid water in the first low-pressure enclosure 10 may be lower than the temperature of the triple point of water.

Figure 9:
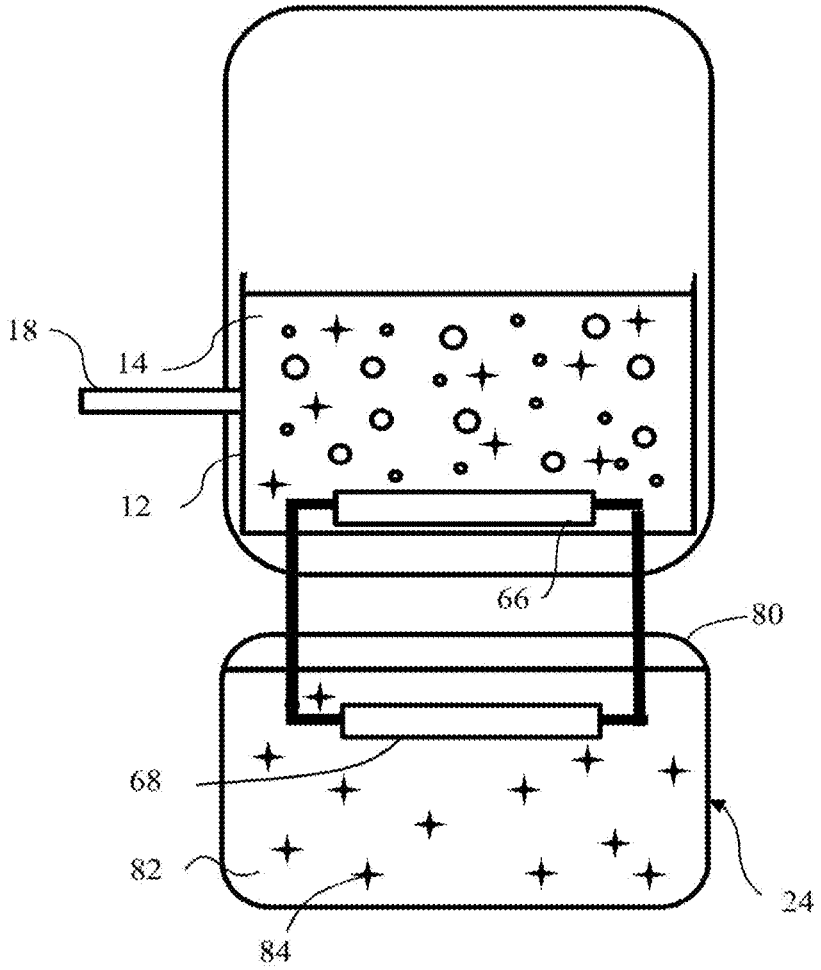
FIG. 9 is a partial and schematic sectional view of a more detailed embodiment of a portion of the refrigeration plant of FIG. 8.

FIG. 9 is a partial and schematic sectional view of a more detailed embodiment of a portion of the refrigeration plant of FIG. 8, wherein the device 24 for extracting cold power from the reservoir 12 has the structure represented in FIG. 7. The second exchanger 68 of the device 24 is located in an enclosure 80 containing water in the liquid state 82 and makes it possible to cool the water in the liquid state 82 until obtaining, in the enclosure 80, water in the solid state 84. The pressure in the enclosure 80 may advantageously be higher than the saturated vapor pressure of the water at the temperature of the triple point of water, and be, for example, at atmospheric pressure. According to another embodiment, the first heat exchanger 66 is not present and the liquid circulating in the heat exchanger 68 corresponds to the liquid water 14 present in the reservoir 12.

Figure 10:
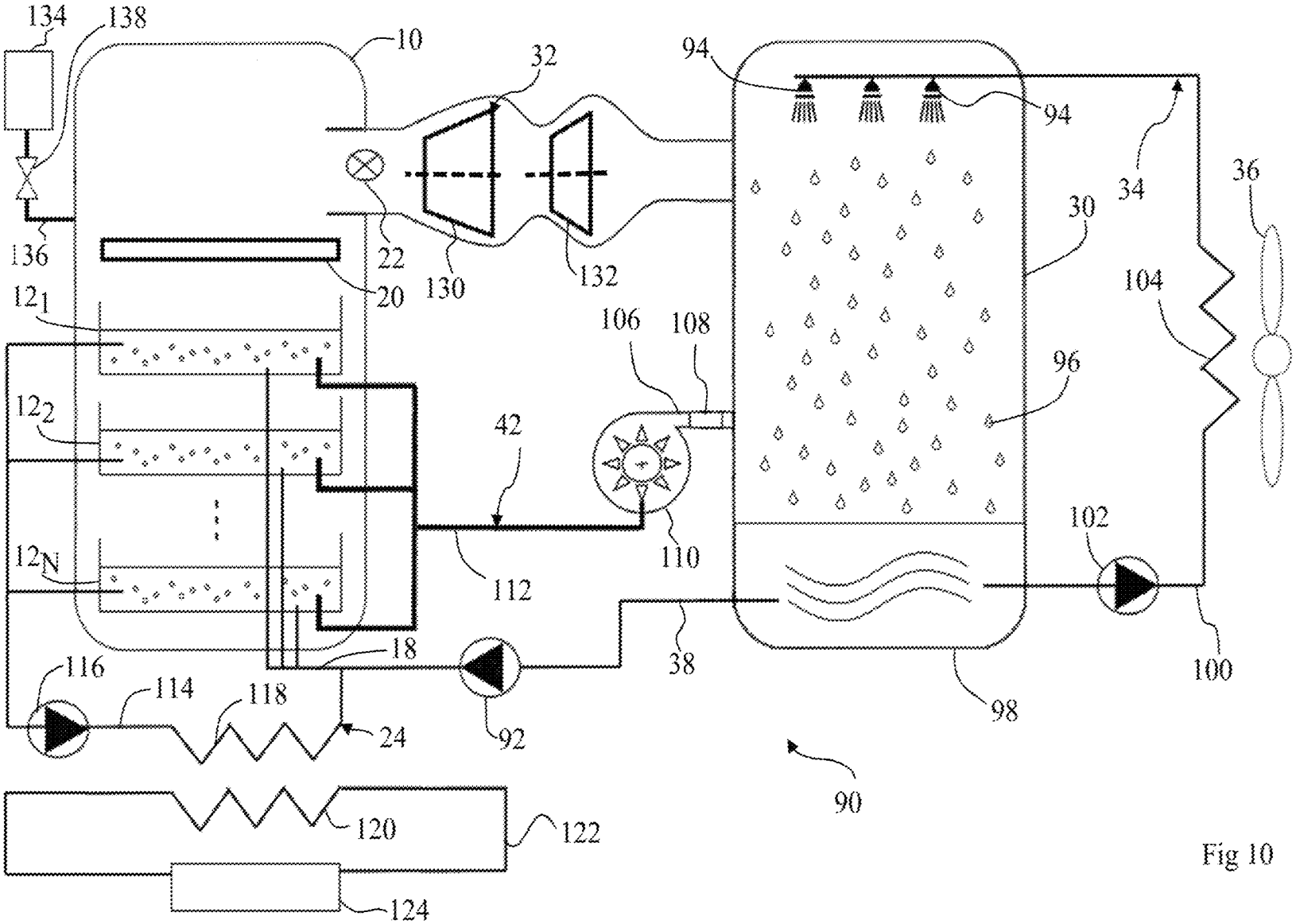
FIG. 10 is a partial and schematic sectional view of another embodiment of a refrigeration plant.

FIG. 10 is a partial and schematic sectional view of an embodiment of a refrigeration plant 90. The refrigeration plant 90 comprises all the elements of the refrigeration plant 5 represented in FIG. 1 with the difference that the unique reservoir 12 of the refrigeration plant 5 is replaced by N reservoirs $\mathbf{12}_1$ to $\mathbf{12}_N$ located in the first low-pressure enclosure 10, N being an integer varying from 1 to 100. The water supply pipe 18 is connected to each reservoir $\mathbf{12}_1$ to $\mathbf{12}_N$. The use of several reservoirs $\mathbf{12}_1$ to $\mathbf{12}_N$ allows increasing, in a simple way, the surface of the liquid/vapor interface for the same volume of liquid water compared to a single reservoir. Furthermore, the stirring of the liquid water, in particular by bubbling, is more effective when the height of liquid water is reduced. In the present embodiment, the heating device 22 is represented for example inside the inlet pipe of the compressor 32 which opens into the first low-pressure enclosure 10.

In the present embodiment, the pipe 38 for recovering the liquid water produced by the condenser 34 is connected to the pipe 18 and the liquid water recovered by the pipe 38 is discharged into the reservoirs $\mathbf{12}_1$ to $\mathbf{12}_N$ by means of a pump 92, for example a positive displacement pump. According to another embodiment, the pump 92 may be absent, the circulation of liquid water in the pipes 18 and 38 then resulting only from the pressure difference between the enclosures 10 and 30.

In the present embodiment, the condenser 34 comprises nozzles 94 for projecting liquid water into the second low-pressure enclosure 30 in the form of droplets 96, three nozzles 94 being represented as example in FIG. 10. The cold droplets 96 promote the condensation of the water vapor expelled in the second low-pressure enclosure 30 by the compressor 32, by multiplying the vapor/liquid interfaces promoting the adsorption of water vapor. The liquid water is collected in a reservoir 98, formed for example by the bottom of the second low-pressure enclosure 30. The pipe 38 recovers a portion of the liquid water present in the reservoir 98. The condenser 34 further comprises a hydraulic circuit 100 in which circulates a portion of the liquid water present in the reservoir 98, intended to supply the nozzles 94 with cooled water. The hydraulic circuit 100 comprises a pump 102 for circulating the liquid water and a heat exchanger 104 located outside the second low-pressure enclosure 30, for example a heat exchanger cooled by ambient air, the condenser 34 comprising means, for example the previously described fan 36, for circulating ambient air throughout the heat exchanger 104. Alternatively, the exchanger 104 may be cooled by another source, for example a waterway. The liquid water expelled by the nozzles 94, which has been cooled by the exchanger 104, is for example at ambient temperature. According to one embodiment, the temperature of the droplets 96 at the outlet of the nozzles 94 is lower than the temperature of the liquid water that feeds the hydraulic circuit 100 by at least 10° C.

In the present embodiment, the system 42 for regulating the pressure difference between the second low-pressure enclosure 30 and the first low-pressure enclosure 10 comprises a pipe 106 connected to the second low-pressure enclosure 30 in the portion of the enclosure 30 containing water vapor, the pipe 106 being equipped with a flow rate regulation controllable valve 108 and supplies an expansion turbine 110. The outlet of the turbine 110 is connected to a pipe 112 which supplies each reservoir $\mathbf{12}_1$ to $\mathbf{12}_N$. The turbine 110 receives water vapor at the pressure of the second low-pressure enclosure 30, which is already cooled by the droplet condenser 34, and provides a two-phase mixture comprising liquid water and water vapor. The rotational speed of the turbine 110 is adjusted so that the pumped water vapor has the desired pressure. According to one embodiment, in the two-phase mixture at the outlet of the turbine 110, the liquid water has been cooled by expansion and the water vapor is substantially at the desired pressure in the first low-pressure enclosure 10. The water vapor expelled through the pipe 112 in each reservoir $\mathbf{12}_1$ to $\mathbf{12}_N$ may advantageously serve as a stirrer of the liquid water present in the reservoirs $\mathbf{12}_1$ to $\mathbf{12}_N$ and further promotes the cooling of the liquid water contained in the reservoirs $\mathbf{12}_1$ to $\mathbf{12}_N$. The turbine 110 and the valve 108 may be controlled by the processing module 40, not represented in FIG. 10.

In the present embodiment, the device 24 for extracting cold power from the reservoirs $\mathbf{12}_1$ to $\mathbf{12}_N$ comprises a hydraulic circuit 114 connected to the reservoirs $\mathbf{12}_1$ to $\mathbf{12}_N$ in which circulates a portion of the water present in the reservoirs $\mathbf{12}_1$ to $\mathbf{12}_N$. The hydraulic circuit 114 comprises a pump 116 for circulating the liquid water and a heat exchanger 118 located outside the first low-pressure enclosure 10, for example a heat exchanger cooperating with a heat exchanger 120 of another hydraulic circuit 122 connected to a device 124 to be cooled. As represented in FIG. 10, the hydraulic circuit 114 may be connected to the pipe 18 for the delivery of the liquid water circulating in the hydraulic circuit 114 to the reservoirs $\mathbf{12}_1$ to $\mathbf{12}_N$.

In the present embodiment, the turbo-compressor 32 comprises two successive stages 130 and 132. The first stage 130 has a fixed compression ratio, for example equal to about 3, and the second stage 132 has a controllable variable compression ratio. The rotational speed of the second turbomachine 132 can be controlled by the processing module 40, not represented in FIG. 10. Preferably, each stage 130, 132 corresponds to a turbo-compressor. The first stage 130 makes it possible to control the flow rate of water vapor extracted from the first low-pressure enclosure 10. The second stage 132 makes it possible to set the pressure of the water vapor discharged into the second low-pressure enclosure 30.

In FIG. 10, there is further represented a primary vacuum pump 134 connected to the first low-pressure enclosure 10 via a pipe 136 equipped with a controllable valve 138.

Particular embodiments have been described. Various variants and modifications will appear to those skilled in the art. In particular, although in the previously described embodiments, the condenser 34 is a condenser in which the water vapor is cooled and liquefied by ambient air, other types of condenser 34 may be used, for example a liquid-cooled condenser.

The invention claimed is:

1. A refrigeration plant comprising:

a first enclosure containing water in the liquid state at a temperature lower than the temperature of the triple point of water, water in the gaseous state at a first pressure equal, to within 10%, to the saturated vapor pressure of the water in equilibrium with the pressure of the water in the liquid state in the first enclosure, and water in the solid state at a temperature lower than the temperature of the triple point of water, the first enclosure comprising at least one reservoir of water in the liquid state;

means for maintaining the water in the liquid state at the temperature lower than the temperature of the triple point of water in the first enclosure;

a second enclosure at a second pressure strictly higher than the first pressure by a factor of at least two;

a compression device connecting the first enclosure to the second enclosure adapted to provide a compression ratio greater than two;

a condensing device partly housed in the second enclosure and adapted to condense the water in the gaseous state in the second enclosure into water in the liquid state; and a cold power extraction device for extracting cold power from the first enclosure;

wherein the compression device comprises two successive stages, each stage corresponding to a turbo-compressor, with a first compressor stage with a fixed compression ratio and a second compressor stage with a controllable compression ratio, the rotational speed of the turbo-compressor being controlled by a processing module, wherein the means for maintaining the water in the liquid state at the temperature lower than the temperature of the triple point of water comprises at least one additive added to the water in the liquid state, and wherein the refrigeration plant further comprises a system for regulating the pressure difference between the second enclosure and the first enclosure, comprising an expansion turbine configured to expand water in the gaseous state from the second enclosure and discharge a mixture containing water in the gaseous state and water in the liquid state in the first enclosure, said mixture being discharged into water in the liquid state contained in said reservoir.

2. The refrigeration plant according to claim 1, comprising a device for heating water in the gaseous state in the first enclosure intended to supply the compression device.

3. The refrigeration plant according to claim 1, wherein the water circulates in a closed circuit in the plant.

4. The refrigeration plant according to claim 1, wherein the condensing device comprises a first heat exchanger outside the second enclosure and means for circulating a first heat-transfer fluid throughout the first heat exchanger, the first heat-transfer fluid is ambient air or water from a watercourse, a body of water and/or a water table.

5. The refrigeration plant according to claim 1, wherein the cold power extraction device comprises a hydraulic circuit in which circulates part or all of the water in the liquid state present in the first enclosure, the hydraulic circuit comprising a second heat exchanger located outside the first enclosure or the cold power extraction device comprises a closed hydraulic circuit in which circulates a second heat-transfer fluid, the hydraulic circuit comprising a second heat exchanger located outside the first enclosure and a third heat exchanger disposed in the first enclosure.

6. The refrigeration plant according to claim 1, further comprising, in the first enclosure, a device for protecting the compression device against the admission of particles in the solid and/or liquid state.

7. The refrigeration plant according to claim 1, wherein the condensing device comprises at least one nozzle for projecting droplets of water in the liquid state in the second enclosure.

8. A system for producing artificial snow comprising a refrigeration plant according to claim 1.

9. The refrigeration plant according to claim 1, wherein the first stage controls the flow rate of water vapor extracted from the first enclosure and the second stage sets the pressure of the water vapor discharged in the second enclosure.

10. The refrigeration plant according to claim 1, wherein the temperature of the liquid water in the reservoir remains substantially constant and equal to a temperature below the triple point temperature of pure water and wherein the pressure of the first enclosure is substantially equal to the saturated vapor pressure of the water in equilibrium with the pressure of the water in the liquid state at the temperature below the temperature of the triple point of water.

11. The refrigeration plant according to claim 2, wherein the temperature of the liquid water in the reservoir remains substantially constant and equal to a temperature below the triple point temperature of pure water and wherein the pressure of the first enclosure is substantially equal to the saturated vapor pressure of the water in equilibrium with the pressure of the water in the liquid state at the temperature below the temperature of the triple point of water.

12. The refrigeration plant according to claim 1, wherein the temperature of the liquid water in the reservoir is higher than or equal to the temperature of the triple point pure water.

13. The refrigeration plant according to claim 2, wherein the temperature of the liquid water in the reservoir is higher than or equal to the temperature of the triple point pure water.

14. The refrigeration plant according to claim 1, comprising a heating device for heating water in the gaseous state in the first enclosure intended to supply the compression device, the heating device comprising a source of microwave radiation and/or a source of infrared radiation.

15. A method for producing cold comprising the following steps of:

bringing in a first enclosure water in the liquid state at a temperature lower than the temperature of the triple point of water, forming water in the gaseous state at a first pressure equal, to within 10%, to the saturated vapor pressure of the water in equilibrium with the pressure of the water in the liquid state in the first enclosure, forming water in the solid state at a temperature lower than the temperature of the triple point of water, and providing an additive to maintain the water in the liquid state at the temperature lower than the triple point of water;

compressing water in gaseous state from the first enclosure to a second enclosure at al second pressure strictly higher than the first pressure by a factor of at least two, by a compression device comprising two successive stages, each stage corresponding to a turbo-compressor, with a first compressor stage with a fixed compression ratio and a second compressor stage with a controllable compression ratio, the rotational speed of the second turbo-compressor being controlled by a proceeding module;

condensing the water in the gaseous state in the second enclosure into water in the liquid state;

extracting cold power from the first enclosure; and regulating the pressure difference between the second enclosure and the first enclosure by expanding water in the gaseous state from the second enclosure and by discharging a mixture containing water in the gaseous state and water in the liquid state in the first enclosure, said mixture being discharged into water in the liquid state contained in a reservoir of the first enclosure.

16. The method according to claim 15, further comprising the step of heating the water in the gaseous state in the first enclosure intended to be compressed.

* * * * *